US005405133A

United States Patent [19]

Upton

[11] Patent Number: 5,405,133

[45] Date of Patent: Apr. 11, 1995

[54] FOLDING BALL MARK REPAIR TOOL

[76] Inventor: Lyle Upton, 403 S. Madison St., Morrison, Ill. 61270

[21] Appl. No.: 231,930

[22] Filed: Apr. 25, 1994

[51] Int. Cl.[6] ..... A63B 57/00

[52] U.S. Cl. ..... 273/32 B; 172/378

[58] Field of Search ..... 273/32 B; 172/378, 379, 172/380

[56] References Cited

U.S. PATENT DOCUMENTS

| | | | |
|---|---|---|---|
| 3,539,017 | 11/1970 | Johnson | 273/32 B X |
| 4,535,987 | 8/1985 | Dikoff | 273/32 B |
| 4,998,726 | 3/1991 | Budnik | 273/32 B X |
| 5,007,129 | 4/1991 | Hainey | 273/32 B X |

*Primary Examiner*—George J. Marlo

[57] ABSTRACT

Disclosed is a folding ball mark repair tool for repairing a ball mark depression in a golf green resulting from impact of a golf ball landing on the green thereby leaving the green free of a surface irregularity that may adversely effect putting conditions. The ball mark repair tool comprises an elongated flat blade for insertion under a concave ball mark in greens turf for prying the turf upwardly for smoothing thereof. The blade has two parallel pointed prongs extending from an end thereof. An elongated flattened handle has a longitudinal central slot formed therein wherein the blade shank is pivotally disposed such that the blade may be pivoted to a storage position thereof wherein the blade is disposed within the slot and a working position thereof wherein the blade is approximately 180° from the storage position extending out of the slot. A spring pivotally biases the blade to the working position. A latch is included whereby the blade may be releasably retained in the storage position. The latch is biased to a blade engageable latch position and also has a blade disengageable release position. The latch also has a finger engagement button formed on one end thereof which projects slightly above the surface of the handle when the rod is in the latch position whereupon finger pressure by a user causes the blade to spring from the storage position to the working position.

6 Claims, 4 Drawing Sheets

FIG. 2
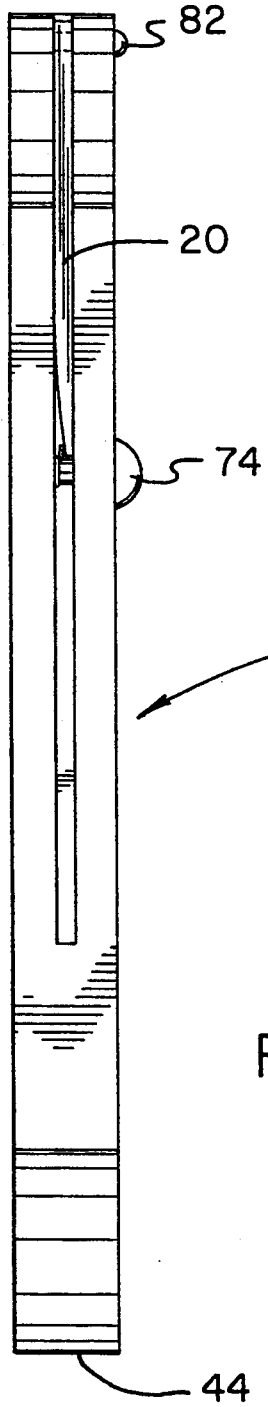
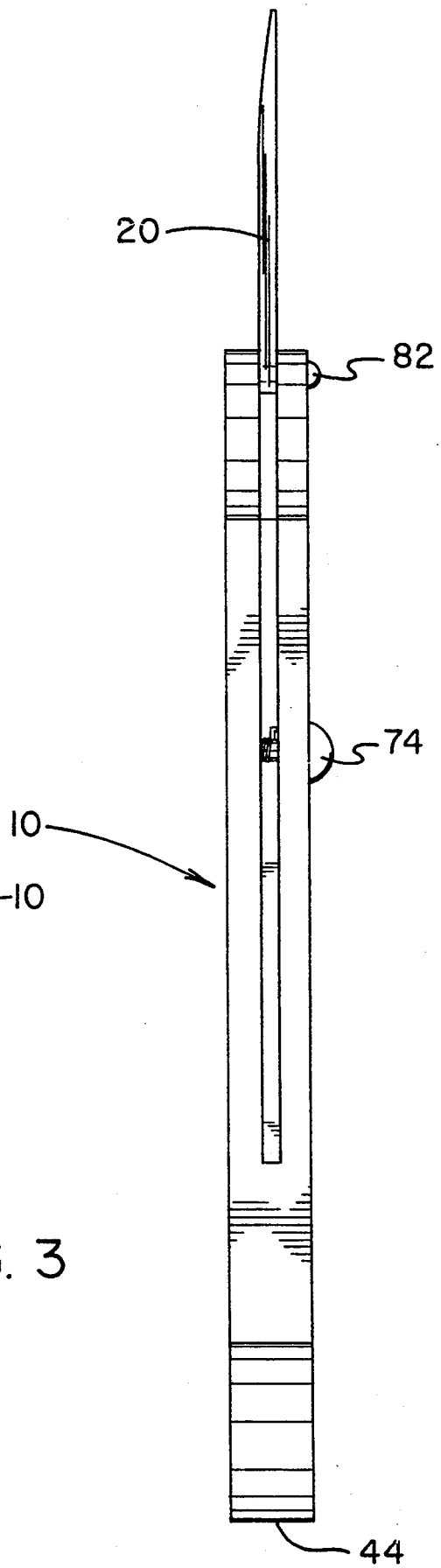
FIG. 3

FOLDING BALL MARK REPAIR TOOL

BACKGROUND OF THE INVENTION

1. Field of the Invention

The present invention relates to golf greens repair tools and more particularly pertains to a folding ball mark repair tool which may be adapted for repairing a ball mark depression in a golf green resulting from impact of a golf ball landing on the green thereby leaving the green free of a surface irregularity that may adversely effect putting conditions.

2. Description of the Prior Art

The use of golf greens repair tools is known in the prior art. More specifically, golf greens repair tools heretofore devised and utilized for the purpose of maintaining a smooth greens surface are known to consist basically of familiar, expected and obvious structural configurations, notwithstanding the myriad of designs encompassed by the crowded prior art which have been developed for the fulfillment of countless objectives and requirements.

The present invention is directed to improving devices for maintaining a smooth greens surface in a manner which is safe, secure, economical and aesthetically pleasing.

The prior art discloses a golf club groove cleaner and turf repair tool of U.S. Pat. No. 5,121,519 to Haugom consisting of a combination device having teeth projecting from one end for cleaning the grooves in the face of most golf clubs heads and also having a pair of large sharp prongs on its opposite end, which can be used to clean golf shoes and to repair divots and golf ball marks in the turf on golf course greens. The invention described in the Haugom patent does not show a way to cover the exposed sharp edges of the device, such as by folding into a handle, thereby providing a device that may be uncomfortable when carried in the user's pocket and may also cause damage to the user's clothing. U.S. Pat. No. 4,862,970 to Hlavacek discloses a greens repair tool adapted to be placed in the shaft of a golf club. The Hlavacek device has a disadvantage in that it must be incorporated into a golf club. There may be times when a golfer, desiring to repair a ball mark, does not have on hand a club so equipped. Furthermore, many golfer's may not wish to have additional devices incorporated into their golf clubs.

The prior art also discloses the following relevant patents: U.S. Pat. No. 4,837,932, U.S. Pat. No. 5,131,149 to Thompson et al., U.S. Pat. No. 4,897,922 to Brooker, and U.S. Pat. No. 4,741,106 to Yamagishi. While these devices fulfill their respective, particular objectives and requirements, the aforementioned patents do not disclose a folding ball mark repair tool for repairing a ball mark depression in a golf green.

U.S. Pat. No. 311,567 to Tyrer is also referenced for general interest.

In this respect, the folding ball mark repair tool according to the present invention substantially departs from the conventional concepts and designs of the prior art, and in so doing provides an apparatus primarily developed for the purpose of repairing a ball mark depression in a golf green resulting from impact of a golf ball landing on the green thereby leaving the green free of a surface irregularity that may adversely effect putting conditions.

Therefore, it can be appreciated that there exists a continuing need for a folding ball mark repair tool. In this regard, the present invention substantially fulfills this need.

As illustrated by the background art, efforts are continuously being made in an attempt to develop devices for maintaining a smooth greens surface. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of golf greens repair tools now present in the prior art, the present invention provides a golf greens repair tool construction wherein the same can be utilized for repairing a ball mark depression in a golf green resulting from impact of a golf ball landing on the green thereby leaving the green free of a surface irregularity that may adversely effect putting conditions. As such, the general purpose of the present invention, which will be described subsequently in greater detail, is to provide a folding ball mark repair tool apparatus and method which has all the advantages of the prior art golf greens repair tools and none of the disadvantages.

The invention is defined by the appended claims with the specific embodiment shown in the attached drawings. For the purpose of summarizing the invention, the invention may be incorporated into a folding ball mark repair tool for repairing a ball mark depression in a golf green resulting from impact of a golf ball landing on the green thereby leaving the green free of a surface irregularity that may adversely effect putting conditions. The ball mark repair tool comprises an elongated flat blade for insertion under a concave ball mark in greens turf for prying the turf upwardly for smoothing thereof. The blade has dull edges formed thereon. The blade also has two parallel pointed prongs extending from a first end thereof, the two prongs defining a longitudinal slot therebetween. The blade further has a shank portion formed on a second end thereof with a pivot hole therethrough proximal the second end. An elongated flattened handle has a longitudinal central slot formed therein, the slot lying along the major plane of the handle. The slot extends from a front end of the handle to a point intermediate the front end and an opposing butt end. The handle has a lateral pivot pin extending therethrough, proximal the front end thereof, and normal the central slot. The pivot pin also extends through the central slot and additionally extends through the pivot hole of the blade whereby the blade may be pivoted to a storage position thereof wherein the blade is disposed within the slot and a working position thereof wherein the blade is approximately 180° from the storage position extending out of the slot. Biasing means is also included whereby the blade is pivotally biased to the working position. The biasing means comprises a torsion coil spring disposed around the pivot pin. The torsion spring has a first end fixed with relation to the handle and also has a second end fixed with relation to the blade whereby urging the blade to the working position. The folding ball mark repair tool further has latch means whereby the blade may be releasably retained in the storage position. The latch means comprises a longitudinally slideable rod disposed within the handle normal the central slot. The rod has a lug projecting laterally therefrom, intermediate the ends thereof, for releasably engaging the longitudinal slot of the blade whereby holding the blade against biasing tension in the storage position. The rod has a latch position wherein the lateral lug is engaged with the blade slot and also has a release position wherein the lug is disengaged from the blade slot. The rod is biased to the latch position with a coil compression spring disposed therearound. The rod also has an enlarged hemispherical finger engagement button formed on one end thereof. The finger button projects slightly above the surface of a side of the handle when the rod is in the latch position whereby finger pressure by a user causes the rod to slide longitudinally from the latch position wherein the blade is held in the storage position, to the release position wherein the blade is allowed to spring to the working position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a folding ball mark repair tool for repairing a ball mark depression in a golf green resulting from impact of a golf ball landing on the green thereby leaving the green free of a surface irregularity that may adversely effect putting conditions.

It is another object of the present invention to provide a folding ball mark repair tool which may be easily and efficiently manufactured and marketed.

It is a further object of the present invention to provide a folding ball mark repair tool which is of a durable and reliable construction.

An even further object of the present invention is to provide a folding ball mark repair tool which is susceptible of a low cost of manufacture with regard to both materials and labor, and which accordingly is then susceptible of low prices of sale to the consuming public, thereby making such folding ball mark repair tools economically available to the buying public.

Still yet another object of the present invention is to provide a folding ball mark repair tool which provides in the apparatuses and methods of the prior art some of the advantages thereof, while simultaneously overcoming some of the disadvantages normally associated therewith.

Still yet another object of the present invention is to provide a folding ball mark repair tool that is easy and fun to use thereby encouraging golfers to seek and repair ball marks.

Yet another object of the present invention is to provide a folding ball mark repair tool that encourages golfers to observe proper golf etiquette by repairing ball marks.

Even still another object of the present invention is to provide a folding ball mark repair tool that is low in cost, unique, and suitable for inexpensive marking processes making it practical for use as a prize, gift, or advertising giveaway item.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a bottom plan view of the invention of FIG. 1 showing the blade in the storage position.

FIG. 3 is another bottom plan view of the invention of FIG. 1 showing the blade in the working position.

DESCRIPTION OF THE PREFERRED EMBODIMENT

Figure 1:
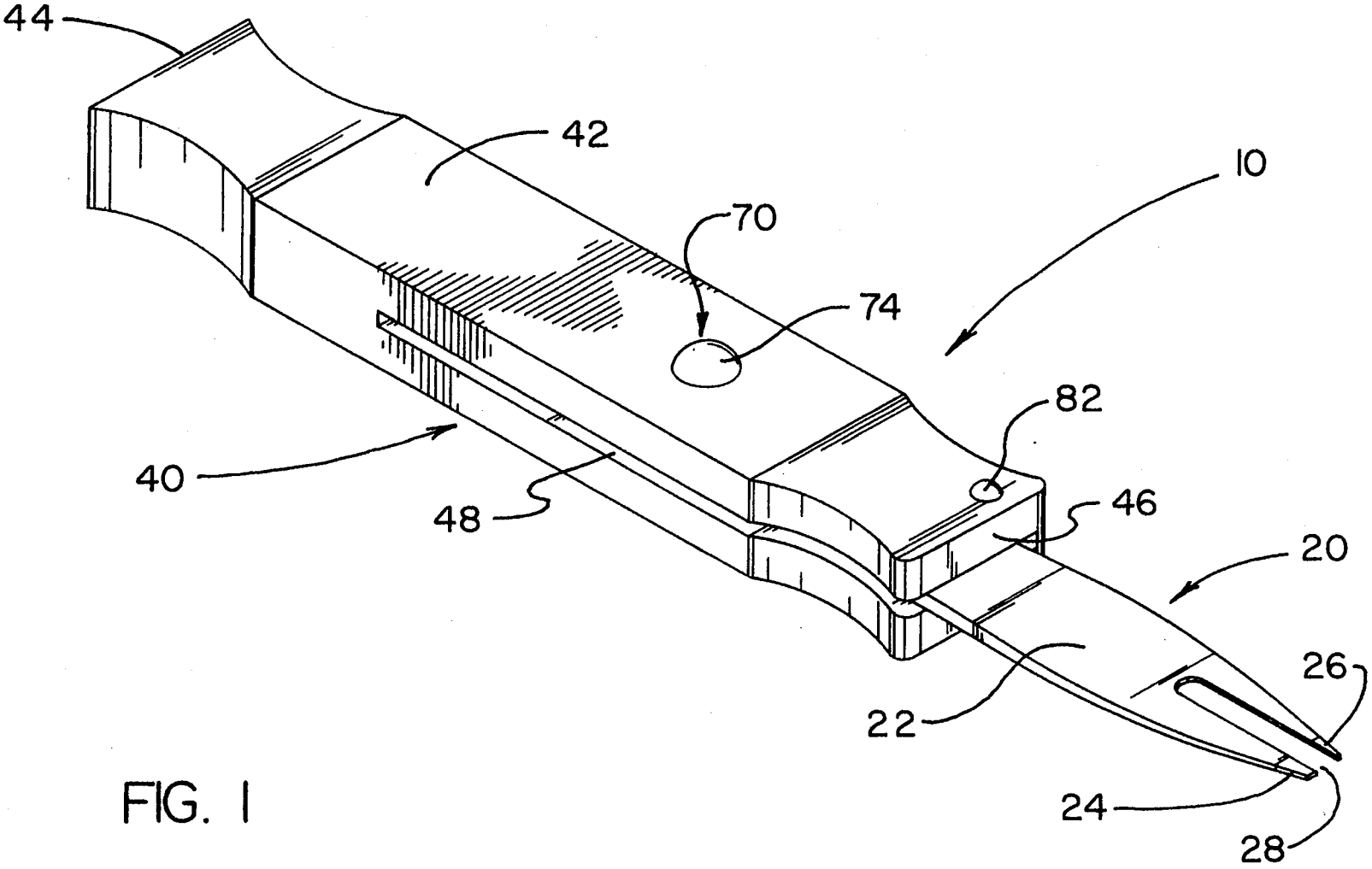
FIG. 1 is a perspective view of the folding ball mark repair tool showing the blade in the working position.
Figure 4:
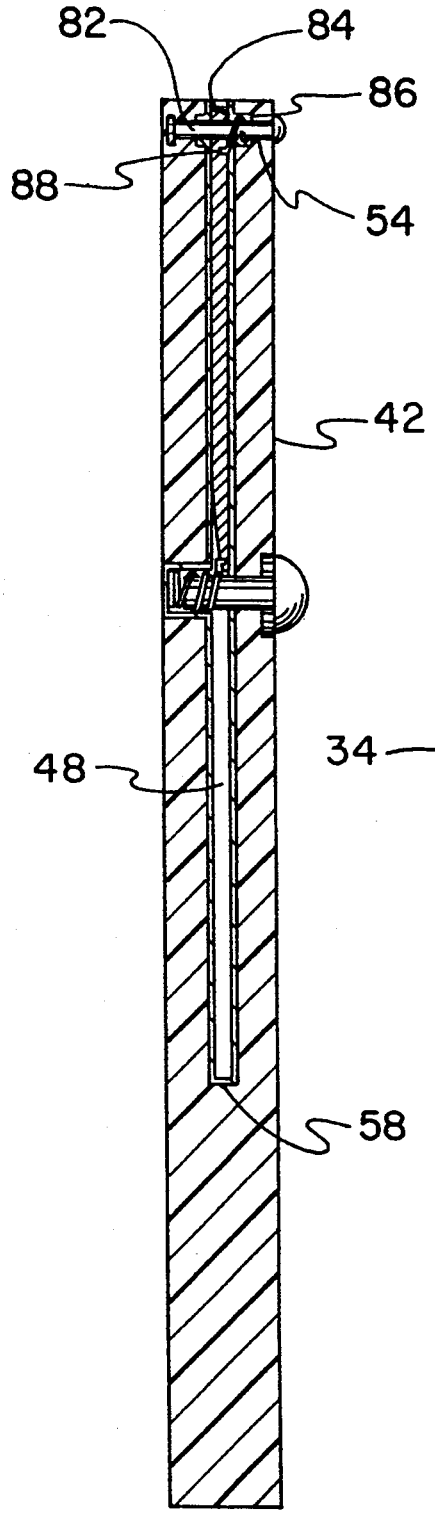
FIG. 4 is a sectional view of the present invention with the blade in the storage position taken along a plane normal the major plane of the device.
Figure 5:
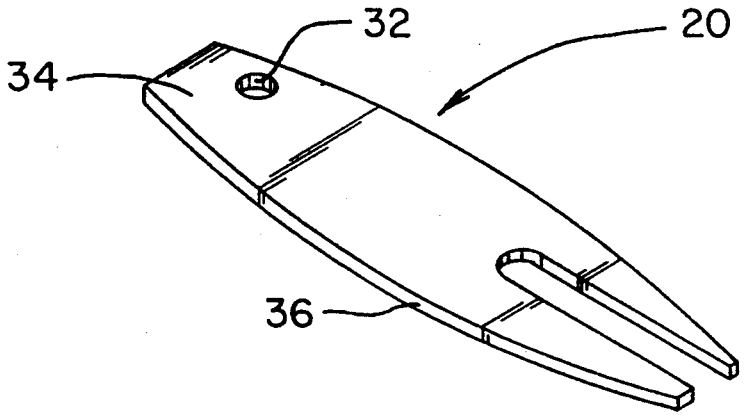
FIG. 5 is a perspective view of the blade of the present invention.
Figure 7:
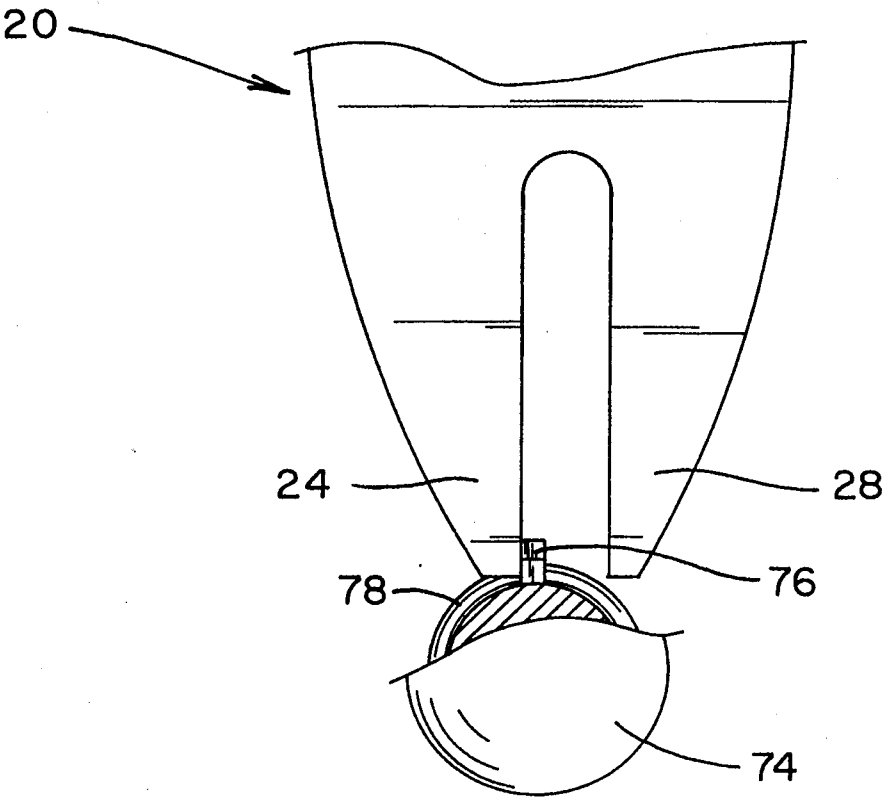
FIG. 7 is a top plan detail view of the blade and blade latch showing the manner of latch engagement with the blade slot.
Figure 6:
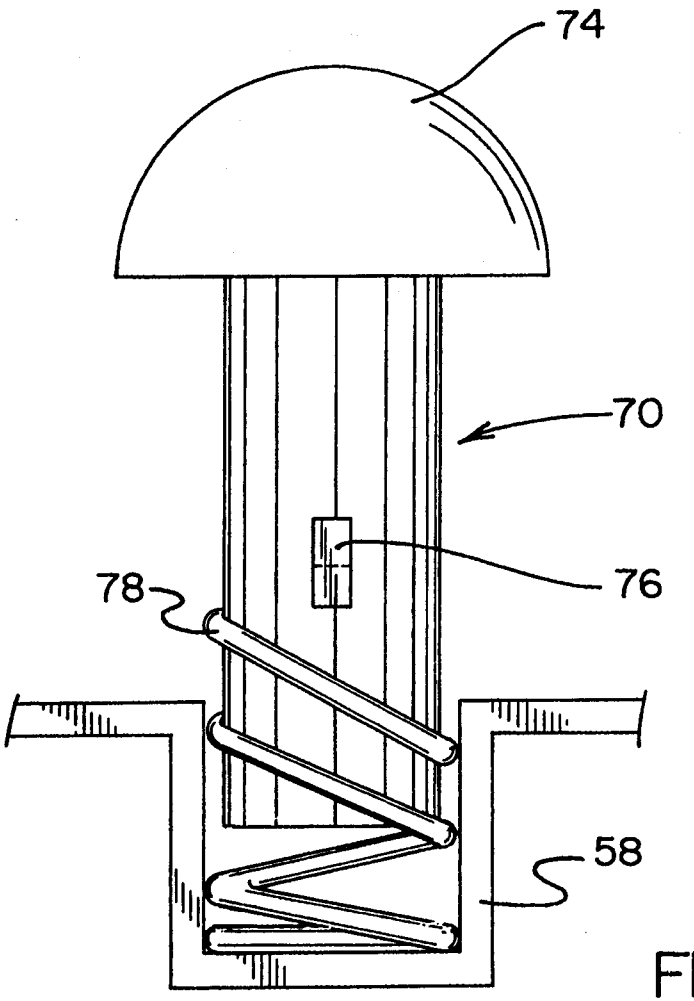
FIG. 6 is a side elevational detail view showing the manner of spring biasing of the blade latch.

With reference now to the drawings, and in particular to FIG. 1 thereof, a folding ball mark repair tool embodying the principles and concepts of the present invention and generally designated by the reference numeral 10 will be described.

From an overview standpoint, the folding ball mark repair tool is adapted for use for repairing a ball mark depression in a golf green resulting from impact of a golf ball landing on the green thereby leaving the green free of a surface irregularity that may adversely effect putting conditions. See FIG. 1.

With reference now to FIGS. 1–7 and more specifically, it will be noted that a folding ball mark repair tool 10 is shown. The ball mark repair tool 10 comprises an elongated flat blade 20 for insertion under a concave ball mark in greens turf for prying the turf upwardly for smoothing thereof. The blade has dull edges 36 formed thereon. The blade also has two parallel pointed prongs 24 and 26 extending from a first end thereof, the two prongs defining a longitudinal slot 28 therebetween. The blade 20 further has a shank portion 34 formed on a second end thereof with a pivot hole 32 therethrough proximal the second end.

An elongated flattened handle 40 has a longitudinal central slot 48 formed therein, the slot lying along the major plane of the handle. The slot 48 has a metallic liner 58 for increasing wear resistance and extends from a front end of the handle 46 to a point intermediate the front end 46 and an opposing butt end 44. The handle 40 has a lateral pivot pin 82 extending therethrough, proximal the front end 46 thereof, and normal the central slot 48. The pivot pin 82 also extends through the central slot 48 and additionally extends through the pivot hole 32 of the blade whereby the blade 20 may be pivoted to a storage position thereof wherein the blade 20 is disposed within the slot 48 and a working position thereof wherein the blade 20 is approximately 180° from the storage position extending out of the slot 48. Biasing means is also included whereby the blade 20 is pivotally biased to the working position.

The biasing means comprises a torsion coil spring 84 disposed around the pivot pin 82. The torsion spring 84 has a first end 86 fixed with relation to the handle 40 and also has a second end 88 fixed with relation to the blade 20 whereby urging the blade 20 to the working position. The folding ball mark repair tool 10 further has latch means whereby the blade 20 may be releasably retained in the storage position. The latch means comprises a longitudinally slideable rod 70 disposed within the handle 40 normal the central slot 48. The rod 70 has a lug 76 projecting laterally therefrom, intermediate the ends thereof, for releasably engaging the longitudinal slot 28 of the blade 20 whereby holding the blade against biasing tension in the storage position. The rod 70 has a latch position wherein the lateral lug 76 is engaged with the blade slot 28 and also has a release position wherein the lug 76 is disengaged from the blade slot 28. The rod 70 is biased to the latch position with a coil compression spring 78 disposed therearound. The rod 70 also has an enlarged hemispherical finger engagement button 74 formed on one end thereof. The finger button 74 projects slightly above the surface of a side 42 of the handle when the rod 70 is in the latch position whereby finger pressure by a user causes the rod to slide longitudinally from the latch position wherein the blade 20 is held in the storage position, to the release position wherein the blade 20 is allowed to spring to the working position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A folding ball mark repair tool for repairing a ball mark depression in a golf green resulting from impact of a golf ball landing on the green thereby leaving the green free of a surface irregularity that may adversely effect putting conditions, the ball mark repair tool comprising:

an elongated flat blade for insertion under a concave ball mark in greens turf for prying the turf upwardly for smoothing thereof, the blade having dull edges formed thereon, the blade also having two parallel pointed prongs extending from a first end thereof, the two prongs defining a longitudinal slot therebetween, the blade further having a shank portion formed on a second end thereof with a pivot hole therethrough proximal the second end;

an elongated flattened handle having a longitudinal central slot formed therein, the slot lying along the major plane of the handle, the slot extending from a front end of the handle to a point intermediate the front end and an opposing butt end, the handle having a lateral pivot pin extending therethrough proximal the front end thereof normal the central slot, the pivot pin also extending through the central slot, the pivot pin additionally extending through the pivot hole of the blade whereby the blade may be pivoted to a storage position thereof wherein the blade is disposed within the slot and a working position thereof wherein the blade is approximately 180° from the storage position extending out of the slot;

biasing means whereby the blade is pivotally biased to the working position, the biasing means comprising a torsion coil spring disposed around the pivot pin, the torsion spring having a first end fixed with relation to the handle and also having a second end fixed with relation to the blade whereby urging the blade to the working position; and latch means whereby the blade may be releasably retained in the storage position, the latch means comprising a longitudinally slideable rod disposed within the handle normal the central slot, the rod having a lug projecting laterally therefrom intermediate the ends thereof for releasably engaging the longitudinal slot of the blade whereby holding the blade against biasing tension in the storage position, the rod having a latch position wherein the lateral lug is engaged with the blade slot and also having a release position wherein the lug is disengaged from the blade slot, the rod being biased to the latch position with a coil compression spring disposed therearound, the rod also having an enlarged hemispherical finger engagement button formed on one end thereof, the finger button projecting slightly above the surface of a side of the handle when the rod is in the latch position whereby finger pressure by a user causes the rod to slide longitudinally from the latch position wherein the blade is held in the storage position to the release position wherein the blade is allowed to spring to the working position.

2. A folding ball mark repair tool for repairing a ball mark depression in a golf green resulting from impact of a golf ball landing on the green thereby leaving the green free of a surface irregularity that may adversely effect putting conditions, the ball mark repair tool comprising:

an elongated flat blade for insertion under a concave ball mark in greens turf for prying the turf upwardly for smoothing thereof, the blade having two parallel pointed prongs extending from a first end thereof, the two prongs defining a longitudinal slot therebetween, the blade further having a shank portion formed on a second end thereof;

an elongated flattened handle having a longitudinal central slot formed therein wherein the blade shank portion is pivotally mounted on pivot means, the blade having a storage position thereof wherein the blade is disposed within the slot and a working position thereof wherein the blade is approximately 180° from the storage position extending out of the slot;

biasing means whereby the blade is pivotally biased to the working position; and latch means whereby the blade may be releasably held in the storage position against the biasing means tension.

3. The folding ball mark repair tool of claim 2 wherein the pivot means comprises a pivot hole through the shank proximal the second end of the blade, a lateral pivot pin extending through the handle proximal the front end thereof normal the central slot, the pivot pin also extending through the central slot, the pivot pin additionally extending through the pivot hole of the blade.

4. The folding ball mark repair tool of claim 3 wherein the biasing means comprises a torsion coil spring disposed around the pivot pin, the torsion spring having a first end fixed with relation to the handle and also having a second end fixed with relation to the blade whereby urging the blade to the working position.

5. The folding ball mark repair tool of claim 4 wherein the latch means comprises a longitudinally slideable rod disposed within the handle normal the central slot, the rod having a lug projecting laterally therefrom intermediate the ends thereof for releasably engaging the longitudinal slot of the blade whereby holding the blade against biasing tension in the storage position, the rod having a latch position wherein the lateral lug is engaged with the blade slot and also having a release position wherein the lug is disengaged from the blade slot, the rod being biased to the latch position with a coil compression spring disposed therearound, the rod also having an enlarged hemispherical finger engagement button formed on one end thereof, the finger button projecting slightly above the surface of a side of the handle when the rod is in the latch position whereby finger pressure by a user causes the rod to slide longitudinally from the latch position wherein the blade is held in the storage position to the release position wherein the blade is allowed to spring to the working position.

6. The folding ball mark repair tool of claim 5 wherein the central slot of the handle additionally includes a metallic lining for improving resistance to abrasion from the blade being repeatedly moved between the storage and the working positions.

* * * * *